US009790438B2

(12) United States Patent
Garcia, III et al.

(10) Patent No.: US 9,790,438 B2
(45) Date of Patent: Oct. 17, 2017

(54) METHOD FOR REMOVING METALS AND AMINES FROM CRUDE OIL

(75) Inventors: Juan M. Garcia, III, Sugar Land, TX (US); Samuel A. Lordo, Katy, TX (US); Michael L. Braden, Sugar Land, TX (US)

(73) Assignee: ECOLAB USA INC., St. Paul, MN (US)

( * ) Notice: Subject to any disclaimer, the term of this patent is extended or adjusted under 35 U.S.C. 154(b) by 560 days.

(21) Appl. No.: 12/563,583

(22) Filed: Sep. 21, 2009

(65) Prior Publication Data

US 2011/0068049 A1 Mar. 24, 2011

(51) Int. Cl.

| | |
|---|---|
| ***C10G 17/04*** | (2006.01) |
| ***C10G 17/09*** | (2006.01) |
| ***C10G 33/02*** | (2006.01) |
| ***C10G 33/04*** | (2006.01) |
| ***C10G 17/02*** | (2006.01) |

(52) U.S. Cl.

CPC ..... *C10G 17/04* (2013.01); *C10G 17/02* (2013.01); *C10G 17/09* (2013.01); *C10G 33/02* (2013.01); *C10G 33/04* (2013.01); *C10G 2300/202* (2013.01); *C10G 2300/205* (2013.01); *C10G 2300/80* (2013.01); *C10G 2300/805* (2013.01)

(58) Field of Classification Search

CPC ..... C10G 17/02; C10G 17/04; C10G 17/09; C10G 31/08; C10G 33/02; C10G 33/04

USPC ..... 208/252, 265, 282

See application file for complete search history.

(56) References Cited

U.S. PATENT DOCUMENTS

| | | | |
|---|---|---|---|
| 2,175,095 | A | 10/1939 | Stoesser |
| 2,744,853 | A | 5/1956 | Kavanagh et al. |
| 2,767,123 | A | 10/1956 | Hickok et al. |
| 2,778,777 | A | 1/1957 | Powell |
| 2,792,352 | A | 5/1957 | Groote et al. |
| 3,023,160 | A | 2/1962 | Stedman |
| 3,150,081 | A | 9/1964 | Haslam |
| 3,153,623 | A | 10/1964 | Eldib et al. |
| 3,167,500 | A | 1/1965 | Payne |
| 3,322,664 | A | 5/1967 | Paterson et al. |
| 3,449,243 | A | 6/1969 | Stron, Jr. et al. |
| 3,582,489 | A | 6/1971 | Meadow et al. |
| 4,164,472 | A | 8/1979 | Cheng et al. |
| 4,167,214 | A | 9/1979 | Street, Jr. |
| 4,276,185 | A | 6/1981 | Martin |
| 4,292,254 | A | 9/1981 | Leonard |
| 4,326,968 | A | 4/1982 | Blair, Jr. |
| 4,342,657 | A | 8/1982 | Blair, Jr. |
| 4,411,775 | A | 10/1983 | McCoy et al. |
| 4,415,426 | A | 11/1983 | Hsu et al. |
| 4,432,865 | A | 2/1984 | Norman |
| 4,439,345 | A | 3/1984 | Duke |
| 4,518,444 | A | 5/1985 | Albrecht et al. |
| 4,551,239 | A | 11/1985 | Merchant et al. |
| 4,587,005 | A | 5/1986 | Siskin et al. |
| 4,645,589 | A | 2/1987 | Krambeck et al. |
| 4,727,191 | A | 2/1988 | Nalepa |
| 4,737,265 | A | 4/1988 | Merchant, Jr. et al. |
| 4,778,589 | A | 10/1988 | Reynolds |
| 4,778,590 | A | 10/1988 | Reynolds et al. |
| 4,778,591 | A | 10/1988 | Reynolds |
| 4,778,592 | A | 10/1988 | Reynolds |
| 4,789,463 | A | 12/1988 | Reynolds |
| 4,818,410 | A | 4/1989 | Bellos et al. |
| 4,853,109 | A | 8/1989 | Reynolds |
| 4,888,108 | A | 12/1989 | Farnand |
| 4,938,876 | A | 7/1990 | Ohsol |
| 4,988,433 | A | 1/1991 | Reynolds et al. |
| 4,992,210 | A | 2/1991 | Naeger et al. |
| 5,062,992 | A | 11/1991 | McCullough |
| 5,078,858 | A | 1/1992 | Hart et al. |
| 5,080,779 | A | 1/1992 | Awbrey et al. |
| 5,104,578 | A | 4/1992 | McCullough |
| 5,114,566 | A | 5/1992 | Naeger et al. |
| 5,174,957 | A | 12/1992 | McCullough |
| 5,176,847 | A | 1/1993 | Kremer |
| 5,256,305 | A | 10/1993 | Hart |
| 5,282,959 | A | 2/1994 | Roling et al. |
| 5,346,627 | A | 9/1994 | Siefert et al. |
| 5,364,532 | A | 11/1994 | Bellos et al. |
| 5,389,594 | A | 2/1995 | Crump et al. |

(Continued)

FOREIGN PATENT DOCUMENTS

| | | |
|---|---|---|
| be | 5 2000 | 5/2017 |
| CN | 1054261 A | 9/1991 |

(Continued)

OTHER PUBLICATIONS

Arnold, Ken; Stewart, Maurice (2008). Surface Production Operations—Design of Oil Handling Systems and Facilities, vol. 1 (3rd Edition). Elsevier. pp. 440-445.*

J. H. Gary, G. E. Handwerk, "Petroleum Refining Technology and Economics," Third Edition, Marcel Dekker, Inc., pp. 39-69, 1994.

International Search Report and Written Opinion for PCT/US2010/049211.

Hlaverty, B., "Calcium and Iron in Crude Oil." Notes from meeting, Crude Oil Quality Association on HLS and LLS Quality Data, Houston, TX, Oct. 5, 2000.

Rutzin, Steven E., Plant Microtechnique and Microscopy. 1999: Oxford University Press, Inc. New York, Appendix II, Buffers, pp. 223-235.

Weers, J.J. And J. Nguyen, "A New Metals Removal Process for Doba Crude Oil." Presented at the ERTC 9th Annual Meeting, Prague, Czech Republic, Nov. 15, 2004, 15 pages.

(Continued)

*Primary Examiner* — Renee Robinson

(74) *Attorney, Agent, or Firm* — Eric D. Babych; Brinks Gilson & Lione

(57) ABSTRACT

A method of removing metals and amines from crude oil is provided. The method includes adding an effective metal removing amount of one or more hydroxycarboxylic acids selected from lactic acid and malic acid and salts thereof to the crude oil; adding wash water to the crude oil; mixing the crude oil, acid and wash water to form an emulsion; and resolving the emulsion into an aqueous phase and crude oil having a reduced metals content.

13 Claims, No Drawings

(56) References Cited

U.S. PATENT DOCUMENTS

| | | | | |
|---|---|---|---|---|
| 5,395,536 | A | 3/1995 | Brown et al. | |
| 5,446,233 | A | 8/1995 | Lewis et al. | |
| 5,637,223 | A | 6/1997 | Bellos et al. | |
| 5,667,727 | A | 9/1997 | Breen et al. | |
| 5,700,337 | A | 12/1997 | Jacobs et al. | |
| 5,746,908 | A | 5/1998 | Mitchell | |
| 5,804,276 | A | 9/1998 | Jacobs et al. | |
| 5,853,592 | A | 12/1998 | Bellos et al. | |
| 5,948,242 | A | 9/1999 | Ohsol et al. | |
| 5,981,687 | A | 11/1999 | Breen et al. | |
| 6,182,929 | B1 | 2/2001 | Martin et al. | |
| 7,399,403 | B2 | 7/2008 | Garcia, III et al. | |
| 7,497,943 | B2 | 3/2009 | Nguyen et al. | |
| 2004/0045875 | A1* | 3/2004 | Nguyen et al. | 208/251 R |
| 2007/0125685 | A1 | 6/2007 | Goliaszewski et al. | |
| 2010/0163457 | A1 | 7/2010 | Subramaniyam | |

FOREIGN PATENT DOCUMENTS

| | | | |
|---|---|---|---|
| JP | S421992 | B | 1/1967 |
| JP | S6032888 | A | 2/1985 |
| JP | 11241074 | A | 9/1999 |
| JP | 2007291164 | A | 11/2007 |
| SU | 1666520 | | 7/1991 |
| WO | WO 00/52114 | | 9/2000 |
| WO | WO 2004/020553 | A1 | 3/2004 |
| WO | WO 2007/086661 | A1 | 8/2007 |
| WO | WO 2008/007847 | A1 | 1/2008 |
| WO | WO 01/40410 | A1 | 6/2011 |

OTHER PUBLICATIONS

Weers, J.J. and S. Bieber, "Calcium Removal from High TAN Crudes," Petroleum Technology Quarterly, (PTQ), Q3, 2005, pp. 1-4.

Bizek, Vladislav, J. Horáček, R. Řeřicha, and M. KouŠová, "Amine Extraction of Hydroxycarboxylic Acids. 1. Extraction of Citric Acid with 1-Octanol/*n*-Heptane Solutions of Trialkylamine." Industrial & Engineering Chemistry Research (1992), vol. 31, pp. 1554-1562.

Bruckenstein, Stanley and D. F. Untereker, "Acid-Base Reactions between Amines and Carboxylic Acids in Hexane." Journal of the American Chemical Society (1969), vol. 91, No. 21, pp. 5741-5745.

Morrison, Robert Thornton and R. N. Boyd, "Organic Chemistry, Sixth Edition, Chapter 22, Amines I. Preparation and Physical Properties." New Delhi, IN: Prentice-Hall of India, 1997, pp. 821-844.

Alatiqi, I.M. And G.A. Gasmelseed, "Economic Feasibility of Crude Desalting with Multistage Agitated Extractors," Society of Petroleum Engineers 15712, Presentation at 1987 Fifth SPE Middle East Oil Show, Manama, Bahrain, Mar. 7-10, 1987, 7 pages.

Barney, J.E. II, "Determining Trace Metals in Petroleum Distillates," Analytical Chemistry, 1995, vol. 27, No. 1, pp. 1283-1284.

Dyer, S.J., G.M. Graham, and C. Arnott, "Naphthenate Scale Formation—Examination of Molecular Controls in Idealised Systems," Society of Petroleum Engineers 80395, 2003 SPE 5th International Symposium on Oilfield Scale, Aberdeen, UK, Jan. 29-30, 2003, 14 pages.

Gallup, Darrell L., P.C. Smith, J. Chipponeri, a. Ainul, and D. Mulyono, "Formation & Mitigation of 'Metallic Soap' Sludge, Attka, Indonesia Field," Society of Petroleum Engineers 73960, 2002 SPE International Conference on Health, Safety and Environment in Oil and Gas Exploration and Products, Kuala Lumpur, Malaysia, Mar. 20-22, 2002, 16 pages.

Gary, J.H. And G.E. Handwerk, "Petroleum Refining, Chapter 4—Crude Distillation." New York: Marcel Dekker, 1994, pp. 39-69.

Johnson, David, G. McAteer, and H. Zuk, "The Safe Processing of High Naphthenic Acid Content Crude Oils—Refinery Experience and Mitigation Studies," Corrosion 2003, Paper 03645, 2003, pp. 1-18.

Hlaverty, B., Discussion regarding calcium and iron in crude oil, delivered at the Crude Oil Quality Association (COQA) Meeting, Houston, TX, Oct. 5, 2000. May 8, 2017 link to summary of meeting: http://coga-inc.org/meeting-archives, 2 pages.

Kokal, Sunil, "Crude-Oil Emulsions: A State-of-the-Art Review," Society of Petroleum Engineers 77497, 2002 SPE Annual Technical Conference and Exhibition, San Antonio, Texas, Sep. 29-Oct. 2, 2002, 11 pages.

Liu, Guiling, X. Xu, and J. Gao, "Study on the Deferrization and Desalting for Crude Oils." Energy & Fuels, 2004, vol. 18, No. 4, pp. 918-923.

Lordo, Sam a., J.M. Garcia, and S. Garcia-Swofford, "Desalter Acidification Additives and Their Potential Impacts on Crude Units," NACE International Corrosion 2008 Conference & Expo, Paper No. 08556, 12 pages.

Lordo, Sam A., "Identifying and Mitigating Opportunity Crude Impacts," Paper AM-09-42, 2009 NPRA Annual Meeting, Mar. 22-24, 2009, San Antonio, TX, 17 pages.

Mason, Brad, G. Scattergood, and J. Gardenhire, "Handling the Challenge," Hydrocarbon Engineering, Mar. 2008, pp. 49-60.

Mason, Brad and S. Lordo, "Opportunities, Problems and Solutions," Hydrocarbon Engineering, Mar. 2010, pp. 48-55.

Munoz, Rodrigo A.A., P.R.M. Correia, A.N. Nascimento, C.S. Silva, P.V. Oliveira, and L. Angnes, "Electroanalysis of Crude Oil and Petroleum-Based Fuel for Trace Metals: Evaluation of Different Microwave-Assisted Sample Decompositions and Stripping Techniques," Energy & Fuels, 2007, vol. 21, No. 1, pp. 295-302.

"New Crude Oil Project for Texaco Refinery," Texaco Press Release, Jun. 24, 2004, downloaded on May 3, 2017: http://www.prnewswire.com/news-releases/new-crude-oil-project-for-texaco-refinery-75140817.html#, 5 pages.

Poindexter, Michael K., S. Chuai, R.A. Marble, and S.C. Marsh, "Solid Content Dominates Emulsion Stability Predictions," Energy & Fuels, 2005, vol. 19, No. 4, pp. 1346-1352.

Rothrock, J.J., E.R. Birkhimer, and L.N. Leum, Fluid Cracking Catalyst Contamination: Development of a Contaminant Test, Industrial and Engineering Chemistry, Feb. 1957, vol. 49, No. 2, pp. 272-276.

Sax, N. Irving and R.J. Lewis, Sr. "Hawley's Condensed Chemical Dictionary, 11$^{th}$ Edition." New York: Van Nostrand Reinhold, 1987, pp. 285, 1080.

Smith, H. Vernon and K.E. Arnold, "Chapter 19: Crude Oil Emulsions," Petroleum Engineering Handbook, 1987, Society of Petroleum Engineers, pp. 19/1-19/35.

Stiegel, Gary .J., R.E. Tischer, D.L. Cillo, and N.K. Narain, "Catalyst Deactivation in Two-Stage Coal Liquefaction," Industrial & Engineering Chemistry Product Research and Development, 1985, vol. 24, No. 2, pp. 206-213.

Wu, Bencheng, J.Zhu, J. Wang, and C. Jiang, "Technique for High-Viscosity Crude Oil Demetallization in the Liaohe Oil Field," Energy & Fuels, 2006, vol. 20, No. 4, pp. 1345-1349.

Zurlo, Jeffrey A., "Enhancing Desalter Performance to Successfully Process High Metal Crudes," Paper AM-09-39, 2009 NPRA Annual Meeting, dated Mar. 22-24, 2009, San Antonio, Texas, 9 pages.

PCT International Search Report for International Application No. PCT/US2000/005845, dated Jun. 12, 2000, 3 pages.

PCT International Preliminary Examination Report for International Application No. PCT/US2000/005845, completed Apr. 11, 2001, 16 pages.

Letter Responding to First Written Opinion of PCT/US2000/005845, filed Mar. 16, 2001, 24 pages.

PCT International Search Report for International Application No. PCT/US2002/027116, dated Feb. 13, 2003, 1 page.

May 8, 2017 Docket Printout for U.S. District Court, Southern District of Texas, Houston Division (TXSD), Civil Docket for Case No. 4:09-cv-01885.

Jul. 22, 2009 filed with SDTX (Doc 5): Plaintiffs First Amended Complaint and Application for Preliminary Injunction.

Jul. 23, 2009 filed with SDTX (Doc 6): Plaintiffs Memorandum in Support of Application for Preliminary Injunction.

Aug. 7, 2009 filed with SDTX (Doc 15): Defendant's Answer to Plaintiff's First Amended Complaint and Application for a Preliminary Injunction.

(56) References Cited

OTHER PUBLICATIONS

Aug. 21, 2009 filed with SDTX (Doc 19): Plaintiffs' Reply to Defendant's Response to Plaintiff's Application for Preliminary Injunction.
Aug. 27, 2009 filed with SDTX (Doc 22): Plaintiffs' Answer to Defendant's Counterclaim.
Sep. 1, 2009: Hearing: Transcript of Preliminary Injunction Hearing, Day 1 of 2, held Sep. 1, 2009, Redacted Weers's Testimony.
Sep. 4, 2009 filed with SDTX (Doc 31): Proposed Plaintiffs' Preliminary Injunction Order.
Sep. 9, 2009 filed with Sdtx (Doc 33): Proposed Defendant's Amended Order Denying Motion for Preliminary Injunction.
Sep. 11, 2009 filed with SDTX (Doc 35): Signed Court's Memorandum Opinion and Order for Injunctive Relief.
Oct. 12, 2009: Defendant's Initial Disclosures Under FRCP 26(a)(1).
Oct. 12, 2009: Plaintiffs' Disclosure of Asserted Claims and Preliminary Infringement Contentions Against Defendant.
Oct. 13, 2009 filed with SDTX (Doc 50): Plaintiffs' Motion on Remand for Additional Findings of Fact and Entry of Preliminary Injunction.
Oct. 22, 2009 filed with SDTX (Doc 56): Defendant's Opposition to Plaintiffs' Motion on Remand.
Nov. 4, 2009 filed with SDTX (Doc 61): Plaintiffs' Reply to Defendant's Opposition to Plaintiffs' Motion on Remand.
Nov. 5, 2009 filed with SDTX (Doc 63): Plaintiffs' Response to Defendant's Motion for Leave to Supplement the Record.
Nov. 17, 2009: Defendant's Response to Plaintiffs' First Set of Interrogatories (Nos. 1-14).
Nov. 23, 2009: Defendant's Responses to Requests for Admission.
Nov. 23, 2009: Defendant's P.R. 3-3 Preliminary Invalidity Contentions.
Dec. 8, 2009 filed with SDTX (Doc 67): Defendant's Second Amended Answer to Plaintiffs' First Amended Complaint and Application for Preliminary Injunction.
Dec. 11, 2009 filed with SDTX (Doc 72): Signed Court's Amended Memorandum Opinion and Order for Injunctive Relief.
Dec. 11, 2009 filed with USPTO: Patent Owner's Request for *Inter Partes* Reexamination, Statement, and U.S. Pat. No. 7,497,943 to be Reexamined.
Dec. 23, 2009 filed with SDTX (Doc 82): Plaintiffs' Sur Reply to Defendant's Motion for Leave to Further Supplement the Record.
Dec. 28, 2009 filed with SDTX (Doc 83): Plaintiff's Answer to Defendant's Second Amended Counterclaims.
Jan. 19, 2010 filed with SDTX (Doc 84): Joint Claim Construction and Pre-Hearing Statement.
Feb. 4, 2010 issued by USPTO: Order Granting Request for *Inter Partes* Reexamination.
Feb. 4, 2010 issued by USPTO: NonFinal Office Action Re *Inter Partes* Reexamination.
Feb. 10, 2010 Deposition: Oral and Videotaped Deposition of Robert W. Reynolds.
Feb. 11, 2010 Deposition: Oral and Videotaped Deposition of Jerry Weers, PhD.
Feb. 11, 2010 filed with SDTX (Doc 87): Transcript of Proceedings of Motion Hearing held on Nov. 9, 2009.
Feb. 11, 2010 filed with Court of Appeals: Defendant-Appellant's Brief.
Feb. 22, 2010 filed with SDTX (Doc 89): Plaintiffs' *Markman* Brief in Support of Claim Construction.
Mar. 3, 2010 filed in Court of Appeals: Plaintiffs-Appellees' Brief.
Mar. 8, 2010 filed in Court of Appeals: Defendant-Appellant's Reply Brief.
Mar. 8, 2010 filed in Court of Appeals: Joint Appendix.
Mar. 8, 2010 filed with SDTX (Doc 92): Defendant's Responsive Claim Construction Brief Reply Brief in Support of Claim Construction.
Mar. 15, 2010 filed with SDTX (Doc 94): Plaintiffs' Markman Reply Brief in Support of Claim Construction.
Apr. 5, 2010 filed with SDTX (Doc 95): Joint Claim Construction Chart.
Apr. 5, 2010 filed with USPTO: Patent Owner's Response to Office Action.
Mar. 4, 2010 filed with the USPTO: Requester's Written Comments to Patent Owner's Response.
Jun. 11, 2010 filed with SDTX (Doc 104): Signed Order Granting Respondent's Motion for Stay Pending Reexamination of U.S. Pat. No. 7,497,943 by USPTO.
Jul. 16, 2010 filed with USPTO: Requester's Request for Reexamination of USP 7497943.
Sep. 17, 2010 issued by USPTO: Decision to Institute Requester's Reexamination Request.
Aug. 2, 2011 issued by USPTO: NonFinal Office Action Re Inter Partes Reexamination.
Oct. 3, 2011 filed with USPTO: Patent Owner's Amendment Responding to Office Action.
Nov. 2, 2011 filed with USPTO: Requester's Written Comments to Patent Owner Response.
Jan. 23, 2012 filed with USPTO: Patent Owner's Amendment Responding to Notice Re Defective Paper in Inter Partes Reexamination.
Feb. 21, 2012 filed with USPTO: Requester's Written Comments to Patent Owner Response.
Jun. 21, 2012 issued by Uspto: Action Closing Prosecution of Inter Partes Reexamination.
Jul. 23, 2012 filed with USPTO: Patent Owner's Comments and Revised Amendment in Response to Action Closing Prosecution in Inter Partes Reexamination.
Aug. 14, 2012 filed with USPTO: Patent Owner's Comments and Revised Amendment in Response to Action Closing Prosecution in Inter Partes Reexamination.
Mar. 11, 2013 issued by USPTO: Right of Appeal Notice for U.S. Appl. No. 95/000,524 and U.S. Appl. No. 95/001,399.
May 21, 2013 filed with SDTX (Doc 108): Defendant's Motion to Partially Lift the Stay and to Dissolve the Injunction in view of the USTO's Final Decision Rejecting the Asserted Claims During Reexamination of U.S. Pat. No. 7,497,943.
May 21, 2013 filed with SDTX (Doc 109): Defendant's Appendix in Support of Its Motion to Partially Lift the Stay and to Dissolve the Injunction.
May 22, 2013 filed with SDTX (Doc 111): Signed Order for Expedited Response to Defendant's Motion to Lift Stay and to Dissolve the Injunction.
Jun. 2, 2013 filed with SDTX (Doc 112): Plaintiffs' Response to Defendant's Motion to Partially Lift the Stay and to Dissolve the Injunction.
Jun. 11, 2013 filed with USPTO Appeal Board: Appellants' Appeal Brief, with: Appendix B—Evidence: Sax, N. Irving and R.J. Lewis, Sr. "Hawley's Condensed Chemical Dictionary, 11$^{th}$ Edition." New York: Van Nostrand Reinhold, 1987, pp. 285, 1080; Alatiqi, I.M. And G.A. Gasmelseed, "Economic Feasibility of Crude Desalting with Multistage Agitated Extractors," Society of Petroleum Engineers 15712, Presentation at Fifth SPE Middle East Oil Show, Manama, Bahrain, Mar. 7-10, 1987, 7 pages.; Dr. Jerry J. Weers' Declaration of Jul. 23, 2012; Exhibit 3 to Dr. Jerry J. Weers' Declaration of Jul. 123, 2012, Excalibur Containment Removal Technology brochure 2011; and Gary, J.H. And Glen E. Handwerk, "Petroleum Refining, Chapter 4—Crude Distillation." New York: Marcel Dekker, 1994, pp. 39-69. Appendix C—Related Proceedings: Amendment Memorandum Opinion and Order for Injunctive Relief, U.S. District Court, Southern District of Texas, Houston Division, Civil Action No. H-Sep. 1885, U.S. District Judge Kenneth M. Hoyt, signed Dec. 11, 2009; U.S. Court of Appeals for the Federal circuit Denying Appellant's Motion to Stay Order for Injunctive Relieve, Federal Circuit Clerk Jan Horbaly, signed Feb. 1, 2010; U.S. Court of Appeals for the Federal circuit Order Affirming Preliminary Injunctions, 2010-1124, Federal circuit Clerk Jan Horbaly, signed May 7, 2010; and Order Granting Appellant's Motion for Stay Pending Reexamination of U.S. Pat. No. 7,497,943 by the U.S. Patent and Trademark Office, civil Action No. H-09-1885, U.S. district Judge Kenneth M. Hoyt, signed Jun. 11, 2010.

(56) References Cited

OTHER PUBLICATIONS

Jul. 11, 2013 filed with USPTO Appeal Board: Requester's Appeal Brief, with: Exhibit A —with redaction of sensitive information: Transcript of the testimony of Jerry Weers in the Preliminary Injunction Hearing in H-09-CV-1885 before the Honorable Kenneth Hoyt in the Southern District of Texas, entered by the Examiner in the Right of Appeal Notice at p. 3.
Aug 29, 2013 filed with USPTO Appeal Board: Appellant's Rebuttal Brief.
Aug. 7, 2014 filed with USPTO Appeal Board: Declaration of Jerry J. Weers.
Aug. 7, 2014 filed with USPTO Appeal Board: Exhibit 3 to Jerry J. Weers Declaration—Excalibur Containment Removal Technology Brochure 2011.
Sep. 15, 2014 issued by USPTO Appeal Board: Appeal 2014-003628, Patent Appeal Board's Decision—Examiner Affirmed.
Sep. 22, 2014 issued by USPTO Appeal Board: Appeal 2014-003628, Patent Appeal Board's Record of Oral Hearing, hearing held on Aug. 6, 2014.
Oct. 15, 2014 filed with USPTO Appeal Board: Patent Owner's Request for Rehearing.
Nov. 13, 2014 filed with USPTO Appeal Board: Requester's Comments in Opposition to Request for Rehearing.
May 15, 2015 issued by USPTO Appeal Board: Appeal 2014-003628, Patent Appeal Board's Decision on Rehearing—Denied.
Jun. 11, 2015 filed with SDTX (Doc 122): Defendant's Motion to Lift the Stay and to Reopen the Injunction Proceedings in view of the USPTO's Final Decision that the Asserted Claims of U.S. Pat. No. 7,497,943 Are Invalid.
Jun. 22, 2015 filed with SDTX (Doc 126): Plaintiffs' Response to Defendant's Motion to Lift the Stay and Reopen Injunction Proceedings.
Jun. 24, 2015 filed with SDTX (Doc 127): Defendant's Reply in Support of Its Motion to Lift the Stay and to Reopen the Injunction Proceedings in view of the USPTO's Final Decision that the Asserted Claims of U.S. Pat. No. 7,497,943 Are Invalid.
Jun. 30, 2015 filed with SDTX (Doc 128): Signed Order Denying Defendant's Motion to Lift the Stay and to Reopen Injunction Proceedings.
Oct. 5, 2015 filed with Court of Appeals (Doc 13): Brief of Appellant.
Dec. 3, 2015 filed with Court of Appeals (Doc 27): Responsive Brief of Appellee.
Dec. 21, 2015 filed with Court of Appeals (Doc 30): Reply Brief of Appellant.
Jan. 4, 2016 filed with Court of Appeals (Doc 42-1): Corrected Joint Appendix—vol. I.
Jan. 4, 2016 filed with Court of Appeals (Doc 42-2): Corrected Joint Appendix—vol. II.
Jan. 4, 2016 filed with Court of Appeals (Doc 42-3): Corrected Joint Appendix—vol. III.
Mar. 15, 2016 filed by Court of Appeals (Doc 49-1): Court Affirmed Decision that was Appealed (SDTX's Order Denying Defendant's Motion to Lift the Stay and to Reopen Injunction Proceedings.).
Jun. 30, 2016 filed with SDTX (Doc 159): Plaintiff's Complaint and Demand for Jury Trial.
Jun. 30, 2016 filed with SDTX (Doc 159-1): Plaintiff's Exhibits to Complaint.
Jul. 21, 2016 filed with SDTX (Doc 160): Defendants' Motion to Dismiss Plaintiff's Complaint and Demand for Jury Trial Under FRCP 12(b)(6).
Aug. 11, 2016 filed with SDTX (Doc 161): Plaintiff's Opposition to Defendants' Motion to Dismiss.
Aug. 11, 2016 filed with SDTX (Doc 161-1): Plaintiff's Table of Contents to Its Opposition to Defendants' Motion to Dismiss.
Aug. 18, 2016 filed with SDTX (Doc 162): Defendants' Reply in Support of Its Motion to Dismiss Plaintiff's Complaint and Demand for Jury Trial Under FRCP 12(b)(6).
Aug. 25, 2016 filed with SDTX (Doc 164-1): Plaintiff's Surreply in Opposition to Defendants' Motion to Dismiss.
Aug. 25, 2016 filed with SDTX (Doc 164-2): Plaintiff's Table of Contents to Its Surreply in Opposition to Defendants' Motion to Dismiss.
Nov. 29, 2016 filed with SDTX (Doc 193): [Redacted] Plaintiffs Reply in Support of Motion to Compel (Defendants to Produce Documents).
Dec. 12, 2016 filed with SDTX (Doc 212): Defendants' Sur-reply to Plaintiffs Reply in Support of Plaintiff's Motion to Compel Production of Documents.
Jan. 3, 2017 filed with SDTX (Doc 215): Defendants' Original Answer (to Plaintiff's Complaint).
Jan. 11, 2017: Plaintiff's Responses to Defendants' First Set of Requests for Admissions to Plaintiff.
Feb. 8, 2017 filed with SDTX (Doc 226): Plaintiff's Motion to Compel Defendants to Run Plaintiff's Proposed ESI Search Terms for Custodians Nguyen, Kremer, Weers, Littlefield, and Tacchi, or, in the Alternative, to Modify the ESI Order to Allow for Additional Search Terms.
Feb. 23, 2017 filed with SDTX (Doc 236): Defendants' Response to Plaintiff's Motion to Compel Defendants to Run Plaintiff's Proposed ESI Search Terms, or in the Alternative, to Modify the ESI Order to Allow for Additional Search Terms.
Feb. 28, 2017 filed by SDTX (Doc 238): Plaintiff's Reply in Support of Its Motion to Compel Defendants to Run Plaintiff's Proposed Esi Search Terms for Custodians Nguyen, Kremer, Weers, Littlefield, and Tacchi, or, in the Alternative, to Modify the ESI Order to Allow for Additional Search Terms.

* cited by examiner

METHOD FOR REMOVING METALS AND AMINES FROM CRUDE OIL

TECHNICAL FIELD

This invention relates to a process for the removal of metals, particularly calcium, from petroleum crudes having unacceptably high levels of such metals in refinery desalting processes where certain hydroxycarboxylic acids are added to the crude oil rather than to wash water.

BACKGROUND OF THE INVENTION

A few, but increasingly important, petroleum crude feedstocks contain levels of metals such as iron and calcium which render them difficult, if not impossible, to process using conventional refining techniques. For example, calcium contaminants causing particular problems can take the form of non-porphyrin, organometallically-bound compounds. One class of these calcium-containing compounds include calcium naphthenates and their homologous series. These organo-calcium compounds are not separated from the feedstock by normal desalting processes, and in a conventional refining technique they can cause coker furnace fouling, drive residual fuel off specification for metals and result in the very rapid deactivation of hydroprocessing catalysts. One example of feedstocks demonstrating objectionably high levels of calcium compounds are West African Doba crudes.

The use of hydroxycarboxylic acids to aid in the removal of metals including calcium and iron from crude oil in refinery desalting processes is disclosed in U.S. Pat. Nos. 4,778,589 and 4,789,463, respectively.

A method of removing metals from crude oil in refinery desalting processes, in which a variety of acids, including $C_2$-$C_4$ hydroxycarboxylic acid are added to wash water prior to contacting the wash water with crude oil is disclosed in U.S. Pat. No. 7,497,943.

A method of removing iron from crude oil in refinery desalting processes where various chelants are added to the crude oil prior to addition of wash water is disclosed in U.S. Pat. No. 5,080,779.

SUMMARY OF THE INVENTION

We have unexpectedly discovered that addition of hydroxycarboxylic acids including lactic acid and malic acid and wash water separately to crude oil in conventional crude oil desalting operations results in enhanced removal of amines and bound and unbound metal contaminants, particularly calcium, from the crude oil.

Accordingly, in an embodiment, this invention is a method of removing metals and amines from crude oil comprising adding an effective metal removing amount of one or more hydroxycarboxylic acids selected from lactic acid and malic acid and salts thereof to said crude oil; adding wash water to said crude oil; mixing said crude oil, acid and wash water to form an emulsion; and resolving said emulsion into an aqueous phase and crude oil having a reduced metals content.

DETAILED DESCRIPTION OF THE INVENTION

In refinery crude oil desalting operations, a water-in-oil (w/o) emulsion is intentionally formed by adding water, commonly referred to as "wash water" to the crude oil with the wash water being admitted on the order of about 3-10 volume percent based on the crude oil. The wash water is added to the crude and mixed intimately to transfer impurities such as chlorides in the crude to the water phase. The w/o emulsion is then pumped into the desalter unit where separation of the phases occurs due to coalescence of the small water droplets into progressively larger droplets and eventual gravity separation of the oil and underlying water phase.

Desalters are ordinarily provided with electrodes to, impart an electrical field in the desalter. This serves to polarize the dispersed water molecules. The so-formed dipole molecules exert an attractive force between oppositely charged poles with the increased attractive force increasing the speed of water droplet coalescence by from ten to one hundred fold. The water droplets also move quickly in the electrical field, thus promoting random collisions that further enhance coalescence.

Also, the desalters are generally provided with heat imparting means and pressure control means to respectively control temperature and pressure within the vessels. Typically, desalter temperatures are maintained at about 200-300° F. Heat lowers the viscosity of the continuous phase (i.e., oil) therefore speeding the settlement of the coalesced water droplets. It also increases the ability of bulk oil to dissolve certain organic emulsion stabilizers that may have been added or are naturally occurring in the crude.

Desalter pressure is kept high enough to prevent crude oil or water vaporization. Vaporization causes water carry over into the crude oil leaving the desalter. Desalter pressure at operating temperatures should generally be about 20 psi above the crude oil or water vapor pressure, whichever is lower.

Upon separation of the phases from the w/o emulsion, the crude is commonly drawn off the top of the desalter and sent to the fractionator tower in crude units or other refinery processes. The water phase containing water-soluble metal salt compounds and sediment is discharged as effluent.

This invention is an improved refinery desalting operation comprising (i) providing crude oil; (ii) adding wash water to the crude oil and mixing to form and emulsion; and (iii) resolving the emulsion to provide an aqueous phase and crude oil having a reduced metal and amine content in which the improvement comprises adding an effective metal removing amount of one or more hydroxycarboxylic acids selected from malic acid and lactic acid and salts thereof to the crude oil separately from the wash water. Salts of the hydroxycarboxylic acids include, for example, alkali metal salts such as sodium and potassium salts and ammonium salts. "Separately from the wash water" means a separate addition point which may be upstream or downstream of the wash water addition.

"Crude oil" means any hydrocarbon feedstock used in refinery operations including crude petroleum, atmospheric or vacuum residua, solvent deasphalted oils derived from these crudes and residua, shale oil, liquefied coal, beneficiated tar sand, and the like and blends thereof. The crude oil may also be treated with one or more processing aids including solvents, demulsifiers, corrosion inhibitors, and the like. In embodiment, the crude oil is petroleum crude. In an embodiment, the petroleum crude is Doba crude or a crude oil slate comprising Doba crude.

Metals suitable for removal using the process of this invention include, but are not limited to calcium, iron, zinc, silicon, nickel, sodium, potassium, vanadium, and the like and mixtures thereof. In an embodiment, the metals include iron and calcium. In an embodiment, the metal is calcium in its bound and unbound forms.

Amines suitable for removal using the process of this invention include, but are not limited to, monoethanolamine, diethanolamine, triethanolamine, N-methylethanolamine, N,N-dimethylethanolamine, morpholine, N-methyl morpholine, ethylenediamine, methoxypropylamine, N-ethyl morpholine, N-methyl ethanolamine, N-methyl diethanolamine, and the like and mixtures thereof.

The malic and/or lactic acid may be added as an aqueous solution. In an embodiment, the aqueous solution comprises about 40 to about 70 weight percent of the acids.

The effective amount of malic and/or lactic acid is the amount of acid required to achieve the desired amount of metal or amine removal from the crude oil and can be determined by one of skill in the art taking into account the characteristics of the acids, the crude oil being treated and any additional process parameters.

In an embodiment, the amount of acid added to the crude oil is an amount sufficient to result in a pH of about 3 to about 6 in the separated aqueous solution.

In general, about 1 to about 2,000 ppm of the hydroxycarboxylic acids are added to the crude oil. In an embodiment, about 10 to about 500 ppm of the hydroxycarboxylic acids are added to the crude oil.

In an embodiment, the hydroxycarboxylic acid is malic acid.

The hydroxycarboxylic acids may be used in combination with one or more adjuvants employed in refinery desalting processes, including corrosion inhibitors, demulsifiers, pH adjusters, metal complexing agents, scale inhibitors, hydrocarbon solvents, and the like. The adjuvants may be independently added to the crude oil, to the wash water or formulated with the acid solution. For example, oil soluble adjuvants such as demulsifiers and corrosion inhibitors may be added directly to the crude oil while water soluble adjuvants may be formulated with the acids or added to the wash water.

In an embodiment, one or more demulsifiers are added to the crude oil or the wash water.

In an embodiment, one or more corrosion inhibitors are added to the crude oil or the wash water.

In an embodiment, one or more corrosion inhibitors are added to the wash water.

In an embodiment, the hydroxycarboxylic acids are added to the crude oil upstream of the corrosion inhibitor-containing wash water.

In an embodiment, the hydroxycarboxylic acids are added to the crude oil downstream of the corrosion inhibitor-containing wash water.

In an embodiment, one or more metal complexing agents, not including malic acid and lactic acid, to the crude oil or the wash water.

Metal complexing agents include a broad class of chemicals that coordinate or complex metal ions. Representative metal complexing agents include, but are not limited to ethylenediaminetetra acetic acid (EDTA), glycolic acid, gluconic acid, thioglycolic acid, tartaric acid, mandelic acid, citric acid, acetic acid, oxalic acid, nitrolotriacetic acid (NTA), ethylenediamine (EDA), methanesulfonic acid, malonic acid, succinic acid, maleic acid, dithiocarbamates and polymeric dithiocarbamates, and the like and salts thereof.

In a representative refinery application, crude oil containing about 70 ppm calcium is processed in a conventional desalting operation which comprises a preheat train which includes preheat exchangers, a mix valve downstream of the preheat train and an electrostatic desalter. Upwards of 150,000 bbl/day of crude oil containing about 20% (30,000 bbls) of Doba crude oil are processed. Wash water treated with a corrosion inhibitor is added to the crude oil stream at a rate of about 5% (7,500 bbl/day). A 50% aqueous solution of hydroxycarboxylic acid is added to the crude charge at a dosage rate of about 2,000 to about 3500 gal/day upstream of wash water. The crude oil emulsion formed by the mix valve is resolved by electrostatic coalescence in the desalter to effect removal of up to about 95% of the calcium from the crude oil.

The foregoing may be better understood by reference to the following Example, which is presented for purposes of illustration and are not intended to limit the scope of this invention.

Example 1

A 50 weight percent solution of crude oil in toluene is heated for about 20 minutes at 180° F. and the heated crude oil sample is then mixed with a 10 weight percent aqueous solution of hydroxycarboxylic acid. The mixture is heated and shaken for about 30 minutes. At the end of the extraction cycle, the samples are immediately heated for a second, 10-minute heating cycle, after which, the phases are allowed to separate in a separatory funnel. The calcium and iron content of the recovered phases is determined by ICP analysis. The results are summarized in Table 1.

TABLE 1

| Treating agent | Blank | Hydroxycarboxylic acid, 1.54 molar equiv. | Hydroxycarboxylic acid, 2.47 molar equiv. |
|---|---|---|---|
| Calcium Removed | 8.3 ppm | 94.3% | 93% |
| Iron Removed | 35 ppm | 70% | 70% |

While the present invention is described above in connection with representative or illustrative embodiments, these embodiments are not intended to be exhaustive or limiting of the invention. Rather, the invention is intended to cover all alternatives, modifications and equivalents included within its spirit and scope, as defined by the appended claims.

The invention claimed is:

1. A method of removing metals and amines from crude oil comprising adding a 50% aqueous solution of malic acid or a salt thereof to said crude oil; separately adding wash water to said crude oil and mixing said crude oil, acid and wash water to form an emulsion; and resolving said emulsion into an aqueous phase and crude oil having a reduced metals and amines content, wherein the malic acid or salt thereof is added to the crude oil upstream of the wash water, further wherein the malic acid or salt thereof is added to the crude oil before it arrives at any desalter units.

2. The method of claim 1 wherein the metal is calcium.

3. The method of claim 1 wherein the pH of the separated aqueous phase is about 3-6.

4. The method of claim 1 further comprising adding one or more demulsifiers to the crude oil or the wash water.

5. The method of claim 1 further comprising adding one or more corrosion inhibitors to the crude oil or the wash water.

6. The method of claim 1 further comprising adding one or more metal complexing agents, not including malic acid and lactic acid, to the crude oil or the wash water.

7. The method of claim 6 wherein one or more corrosion inhibitors are added to the wash water.

8. The method of claim 1 wherein said emulsion is resolved using electrostatic coalescence.

9. The method of claim 1 wherein the crude oil is petroleum crude.

10. The method of claim 9 wherein the petroleum crude comprises Doba crude.

11. An improved refinery desalting process for removing metals and amines from crude oil comprising (i) providing crude oil;

(ii) adding wash water to the crude oil;

(iii) mixing said crude oil and said wash water to form an emulsion; and (iv) resolving the emulsion to provide an aqueous phase and crude oil having a reduced metal and amine content, the improvement comprising adding a 50% aqueous solution of malic acid or a salt thereof to the crude oil separate from addition of the wash water, wherein the malic acid or salt thereof is added to the crude oil upstream of the wash water, further wherein the malic acid or salt thereof is added to the crude oil before it arrives at any desalter units.

12. The method of claim 1, wherein an amount of the malic acid or the salt thereof added to the crude oil is from 500 ppm to 2,000 ppm.

13. A method of removing metals and amines from crude oil comprising adding an aqueous solution comprising from about 40 weight % to about 70 weight % of malic acid or a salt thereof to said crude oil; separately adding wash water to said crude oil and mixing said crude oil, acid and wash water to form an emulsion; and resolving said emulsion into an aqueous phase and crude oil having a reduced metals and amines content, wherein the malic acid or salt thereof is added to the crude oil upstream of the wash water, further wherein the malic acid or salt thereof is added to the crude oil before it arrives at a desalter unit.

* * * * *